US010844530B2

(12) United States Patent
Jones

(10) Patent No.: US 10,844,530 B2
(45) Date of Patent: Nov. 24, 2020

(54) AUTOMATIC GARMENT WASHER AND DRYER MACHINE

(71) Applicant: Eva L Jones, Chattanooga, TN (US)

(72) Inventor: Eva L Jones, Chattanooga, TN (US)

( * ) Notice: Subject to any disclaimer, the term of this patent is extended or adjusted under 35 U.S.C. 154(b) by 202 days.

(21) Appl. No.: 15/949,962

(22) Filed: Apr. 10, 2018

(65) Prior Publication Data

US 2018/0291545 A1 Oct. 11, 2018

Related U.S. Application Data

(60) Provisional application No. 62/483,526, filed on Apr. 10, 2017.

(51) Int. Cl.

| | |
|---|---|
| ***D06F 29/00*** | (2006.01) |
| ***D06F 33/00*** | (2020.01) |
| ***D06F 34/28*** | (2020.01) |
| ***D06F 58/30*** | (2020.01) |
| *D06F 58/02* | (2006.01) |
| *D06F 58/20* | (2006.01) |
| *D06F 103/00* | (2020.01) |

(52) U.S. Cl.

CPC ..... *D06F 29/005* (2013.01); *D06F 33/00* (2013.01); *D06F 34/28* (2020.02); *D06F 58/30* (2020.02); *D06F 58/02* (2013.01); *D06F 58/20* (2013.01); *D06F 2103/00* (2020.02); *D06F 2210/00* (2013.01)

(58) Field of Classification Search

None

See application file for complete search history.

(56) References Cited

U.S. PATENT DOCUMENTS

| | | | | |
|---|---|---|---|---|
| 6,978,556 | B1 * | 12/2005 | Cornelious | F26B 11/02 34/596 |
| 7,404,303 | B1 * | 7/2008 | Barbosa | D06F 29/00 68/19.2 |
| 9,228,283 | B2 * | 1/2016 | Kappler | D06F 33/02 |
| 2016/0258104 | A1 * | 9/2016 | James | D06F 39/005 |

OTHER PUBLICATIONS

Derwent KR2007022506, drum type washing machine and a control method, 20070227 (Year: 2007).*

* cited by examiner

*Primary Examiner* — Cristi J Tate-Sims

(57) ABSTRACT

The automatic garment washer and dryer machine is an apparatus that automatically washes and dries garments. The apparatus includes a washer unit, a dryer unit, a transfer channel, a release door, a release door actuator, a control unit, a control panel, and a power source. The apparatus directly transfers garments from the washer unit to the dryer unit through the transfer channel. The release door prevents garments that have exited the washer unit from entering the dryer unit. The control unit activates the release door actuator in order to open and close the release door, thereby allowing garments to enter the dryer unit. The control panel allows the user to input and control the preferences of the washer unit and the dryer unit. The power source delivers the necessary power to the control unit, the washer unit, the dryer unit, the release door actuator, and the control panel.

18 Claims, 15 Drawing Sheets

AUTOMATIC GARMENT WASHER AND DRYER MACHINE

The current application claims a priority to the U.S. Provisional Patent application Ser. No. 62/483,526 filed on Apr. 10, 2017.

FIELD OF THE INVENTION

The present invention generally relates to washing machines. More specifically, the present invention both washes and dries clothes without the clothing having to be manually removed from the washing machine to the dryer.

BACKGROUND OF THE INVENTION

People often look for ways to save time and make chores a more efficient and enjoyable experience. Conventional washing machines and dryers, are designed to clean various types of garments. Technology is continuously developing, and it has become an integral part of modern life. Technology brings innovation in a plurality of fields and in addition it also directly affects personal lifestyle. Most modern mobile phones have internet connectivity capabilities, which facilitate for new opportunities and services. Widespread internet access influenced the development of linked appliances in smart home systems. One such smart home system may include washing machines, which are widely used across the globe in various forms. After washing clothes, the user must manually remove the garments from the machine, and load them into the dryer, thus requiring the physical presence of the user for this step. Technology has become virtually integrated into our daily lives, new appliances have various features designed to simplify chores.

The present invention aims to streamline the laundry process, by allowing the user to remotely control a washer and a dryer with a mobile device. By integrating remote control capabilities into these appliances, the user is able to complete the process remotely, and with no physical input except the initial step of loading the washing machine. Advanced control systems allow users to customize specific features of an appliance. It is not uncommon to have refrigerators, microwave ovens, and other kitchen appliances with an interactive touchscreen control panel.

DETAIL DESCRIPTIONS OF THE INVENTION

Figure 1:
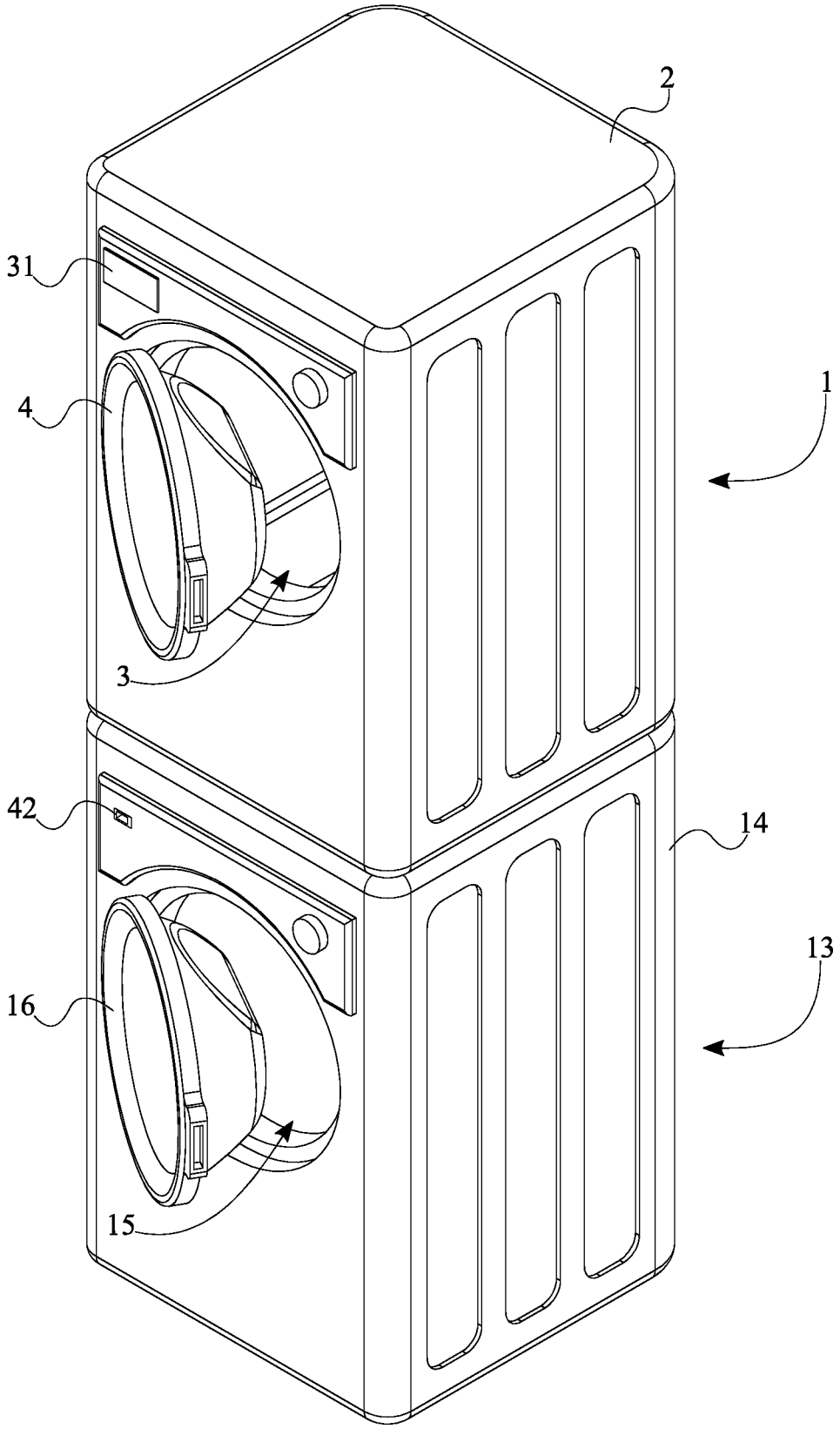
FIG. 1 is a perspective view of the present invention wherein the washer door and the dryer door are extended, and both the first door opening and the second door opening are opened.

All illustrations of the drawings are for the purpose of describing selected versions of the present invention and are not intended to limit the scope of the present invention.

The present invention is an automatic garment washer and dryer machine that automatically washes and dries garments. More specifically, a user is able to remotely control the wash and dry garments without any physical transfer of the garments. In order for the present invention to both wash and dry clothing, the present invention comprises a washer unit 1, a dryer unit 13, a transfer channel 25, a release door 28, a release door actuator 29, a control unit 30, a control panel 31, and a power source 32, as seen in FIG. 1, FIG. 3, FIG. 6, and FIG. 7. The washer unit 1 cleans and rinses soiled garments. The dryer unit 13 applies heat to the wet garments until the garments are dry. The transfer channel 25 allows the wet garments to directly and automatically move from the washer unit 1 to the dryer unit 13. The release door 28 seals the transfer channel 25 until the washer unit 1 has completely cleaned and rinsed the soiled garments. The release door actuator 29 opens and closes the transfer channel 25 with the release door 28 in order for the wet garments within the washer unit 1 to automatically move from the washer unit 1 to the dryer unit 13. The control unit 30 controls all the functions of the washer unit 1, the dryer unit 13, and the release door actuator 29. The control panel 31 allows the user to manually input commands with the control unit 30 and to control the washer unit 1, the dryer unit 13, and the release door actuator 29. In the preferred embodiment of the present invention, the control panel 31 is a touch screen. The power source 32 delivers the necessary power to the washer unit 1, the dryer unit 13, the release door actuator 29, and the control panel 31. The power source 32 is preferably an external power source 32 such as a wall outlet and a power cord.

Figure 2:
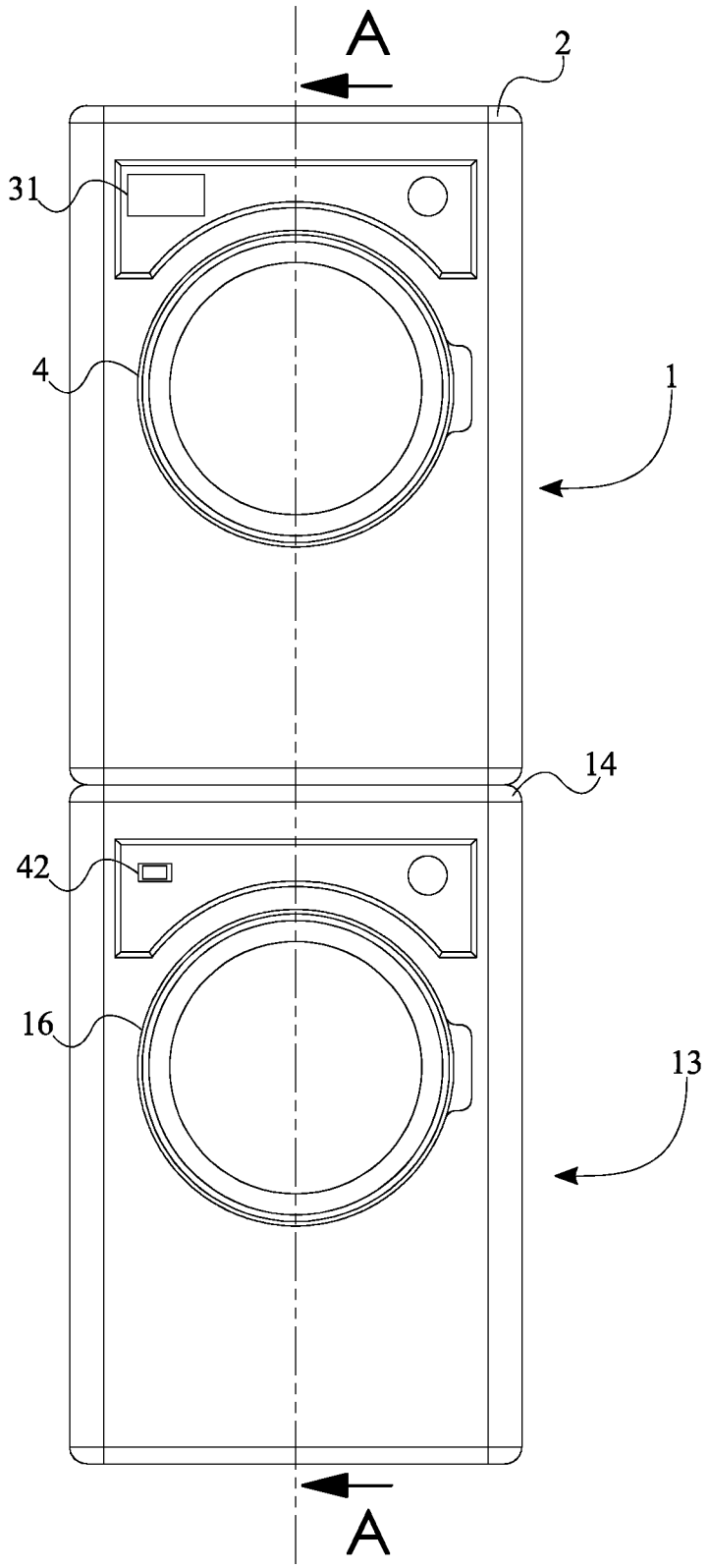
FIG. 2 is a front side view of the present invention.
Figure 4:
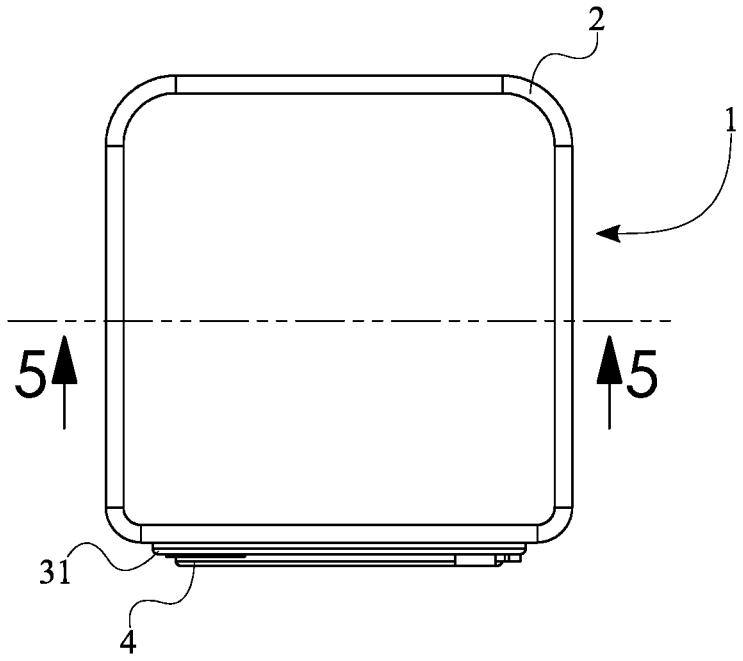
FIG. 4 is a top side view of the present invention.
Figure 5:
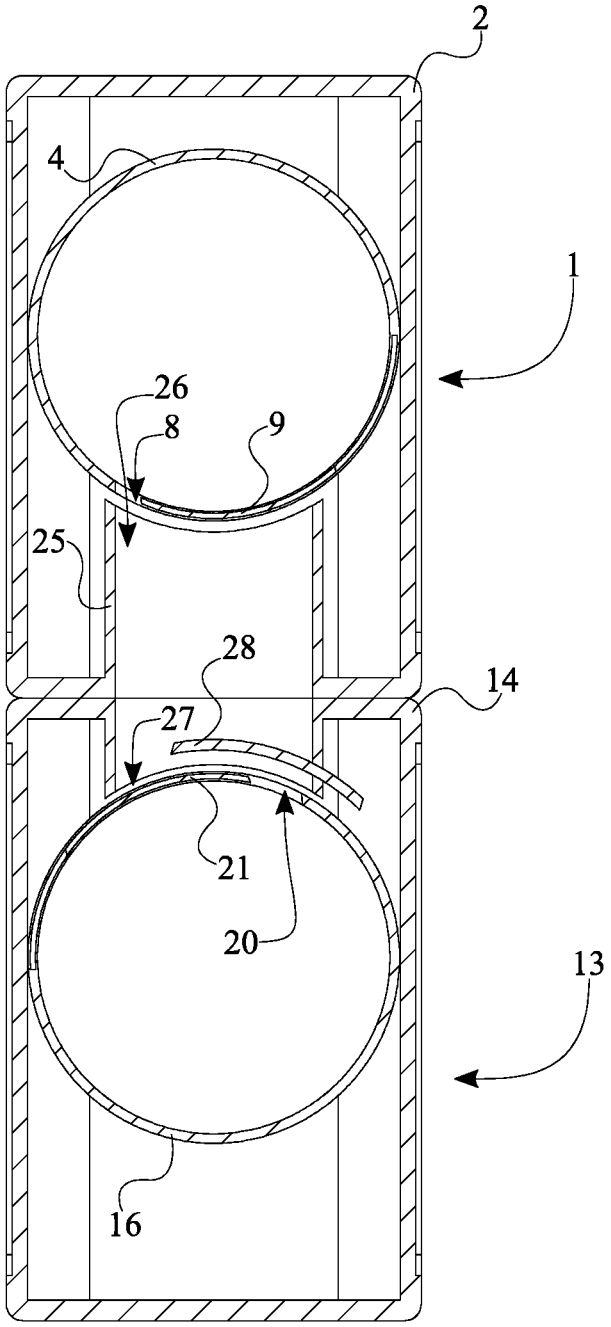
FIG. 5 is a cross-section view of FIG. 4 along line 5-5 of the present invention.

In order for the present invention to transfer the garments from the washer unit 1 to the dryer unit 13, the washer unit 1 is positioned adjacent to the dryer unit 13. As seen in FIG. 2 and FIG. 4, in the preferred embodiment of the present invention, the washer unit 1 is positioned above the dryer unit 13. In this preferred embodiment, gravity is utilized to transfer wet garments from within the washer unit 1 and into the dryer unit 13. In another embodiment of the present invention, the washer unit 1 is laterally positioned adjacent the dryer unit 13. In this alternate embodiment it is understood that an ejector mechanism is integrated into the transfer channel 25 in order to automatically and directly transfer wet garments from the washer unit 1 into the dryer unit 13 while in this configuration. An input opening 26 of the transfer channel 25 traverses from the washer unit 1, shown in FIG. 5. The input opening 26 allows the garments to freely move into, or more specifically fall from, the washer unit 1 to the transfer channel 25. Similarly, an output opening 27 of the transfer channel 25 traverses into the dryer unit 13, also seen in FIG. 5. The output opening 27 allows for a continuous path of the wet garments through the transfer channel 25 and into the dryer unit 13. The release door 28 is positioned adjacent to the output opening 27 of the transfer channel 25, thereby allowing the wet garments to exit the washer unit 1 without entering the dryer unit 13 until the dryer unit 13 has completely finished a cycle and is ready for another load of wet garments. More specifically, this arrangement allows the washer unit 1 and the dryer unit 13 to wash and dry garments independently from one another. In order for the wet garments to enter the dryer unit 13, the release door actuator 29 is operatively coupled in between the transfer channel 25 and the release door 28, wherein the release door actuator 29 is used to open and close the output opening 27 of the transfer channel 25 with the release door 28. The washer unit 1, the dryer unit 13, and the release door actuator 29 are able to function with respect to one another as the control unit 30 is electronically connected to the washer unit 1, the dryer unit 13, the release door 28, and the control panel 31. In order for the electrical components to effectively function, the power source 32 is electrically connected to the control unit 30, the washer unit 1, the dryer unit 13, the release door actuator 29, and the control panel 31.

The washer unit 1 thoroughly rinses and cleans soiled garments as the washer unit 1 comprises a first outer shell 2, a first door opening 3, a washer door 4, a washer drum 5, a first motor 7, a first channel opening 8, and an input door 9, seen in FIG. 3, FIG. 5, FIG. 6, and FIG. 7. The first outer shell 2 contains washer drum 5, the first motor 7, and the input door 9. The first door opening 3 allows soiled garments to enter the washer unit 1. The washer door 4 seals the first door opening 3 as washer unit 1 rinses and cleans the soiled garments. The washer drum 5 contains the soiled garments within the first outer shell 2 while the soiled garments are being rinsed and cleaned. The first motor 7 rotates the washer drum 5 which effectively tumbles the soiled garments within the washer drum 5. The first channel opening 8 allows the wet garments within the washer drum 5 to automatically exit the washer unit 1 and directly enter the dryer unit 13 through the transfer channel 25. The input door 9 seals the washer drum 5 preventing any liquid, soap, or garments from escaping the washer drum 5 while the soiled garments are being rinsed and cleaned.

Figure 3:
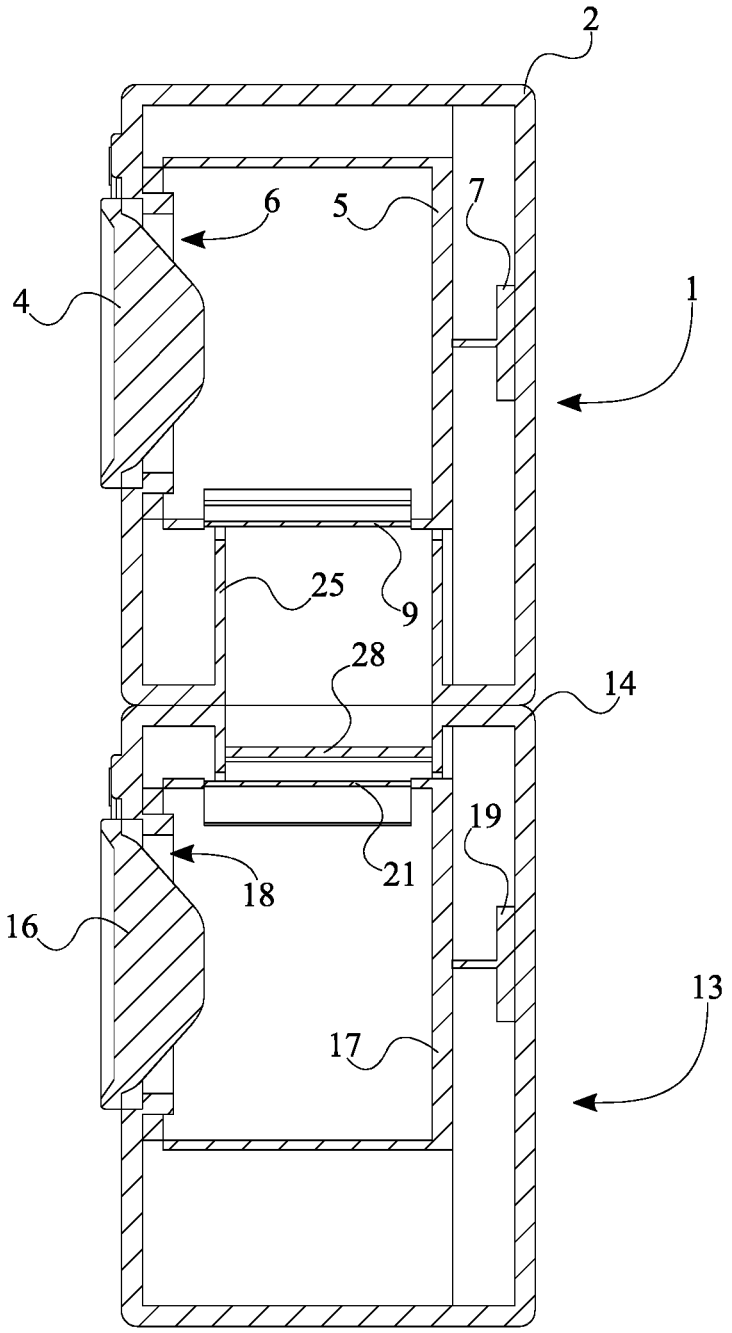
FIG. 3 is a cross-section view of FIG. 2 along line 3-3 of the present invention.

The overall configuration of the aforementioned components allows to washer unit 1 to effectively rinse and clean soiled clothes and transfer wet clothes directly to the dryer unit 13 without the user having to manually move the clothes into the dryer unit 13. The first door opening 3 laterally traverses through the first outer shell 2, and the washer door 4 is hingedly connected to the first outer shell 2, positioned adjacent the first door opening 3, as seen in FIG. 1 and FIG. 3. This arrangement allows the user to place soiled garments within the washer unit 1 and seal the washer unit 1 while the soiled garments are being rinsed and cleaned. More specifically, the washer drum 5 is positioned within the first outer shell 2, and a main opening 6 of the washer drum 5 is positioned adjacent the first door opening 3. In order for the soiled garments to be thoroughly cleaned, regardless of the number of soiled garments within the washer drum 5, the washer drum 5 is rotatably mounted within the first outer shell 2 with the first motor 7. In order for the washed garments to automatically exit the washer unit 1, the first channel opening 8 laterally traverses through the washer drum 5. The input door 9 is slidably connected to the washer drum 5 in order for the input door 9 to be able to seal the first channel opening 8 and open the first channel opening 8 during and after the rinsing and cleaning of the soiled garments, respectively. More specifically, the input door 9 is positioned adjacent the first channel opening 8.

Figure 6:
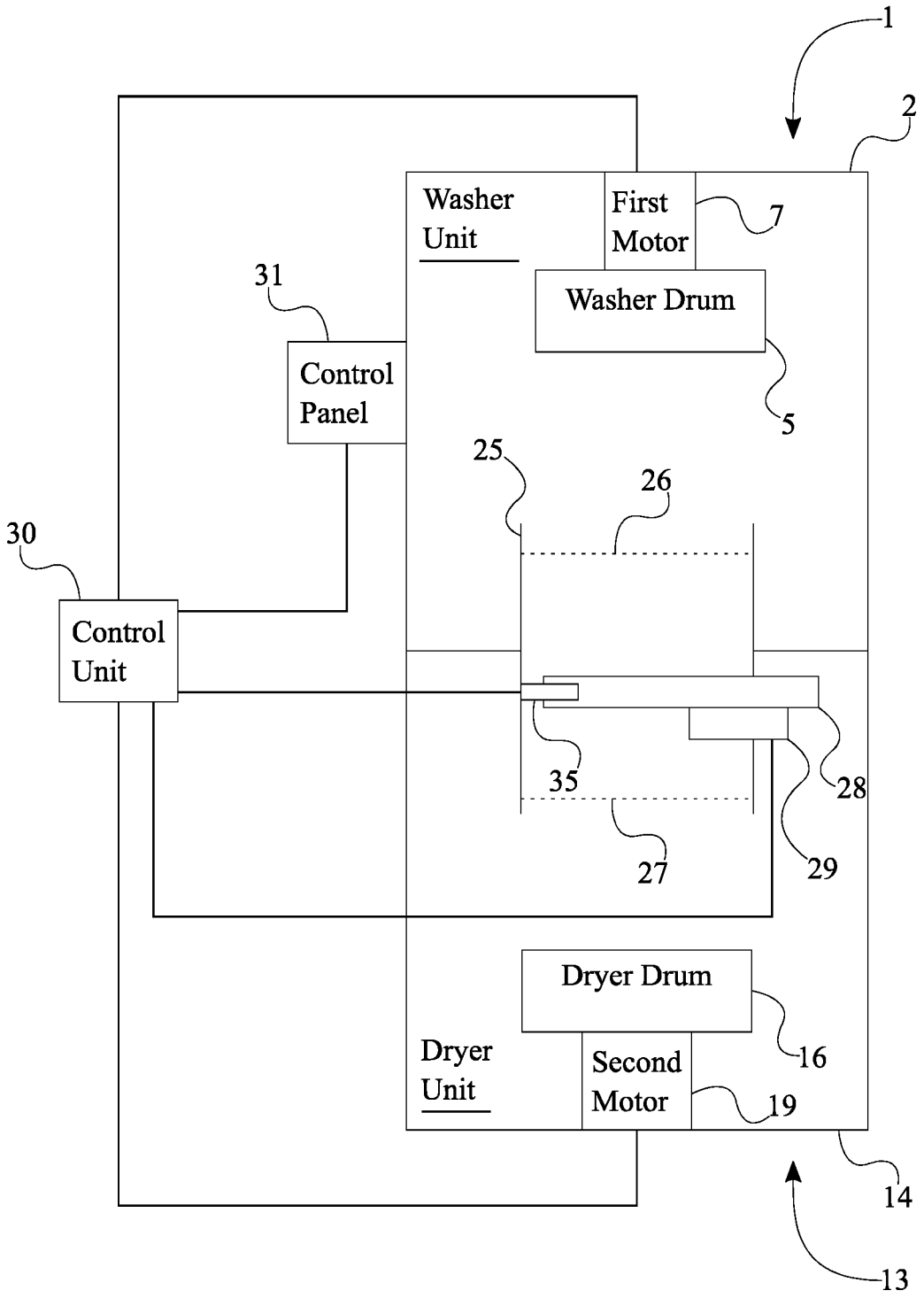
FIG. 6 is a schematic view of the of the electrical components of the present invention with the control unit.
Figure 14:
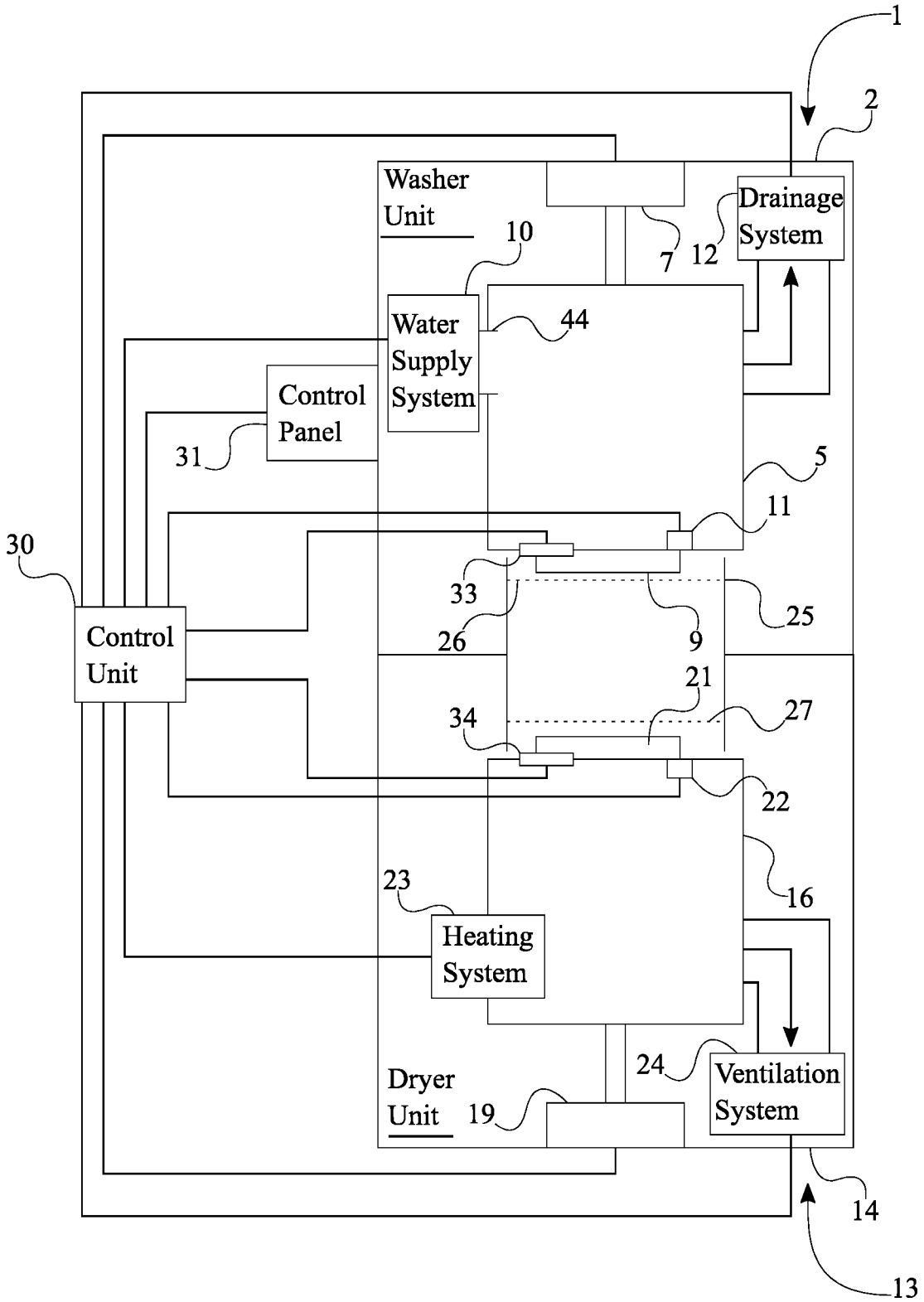
FIG. 14 is a schematic view of the of the electrical components of the washer unit with the control unit of the present invention.
Figure 15:
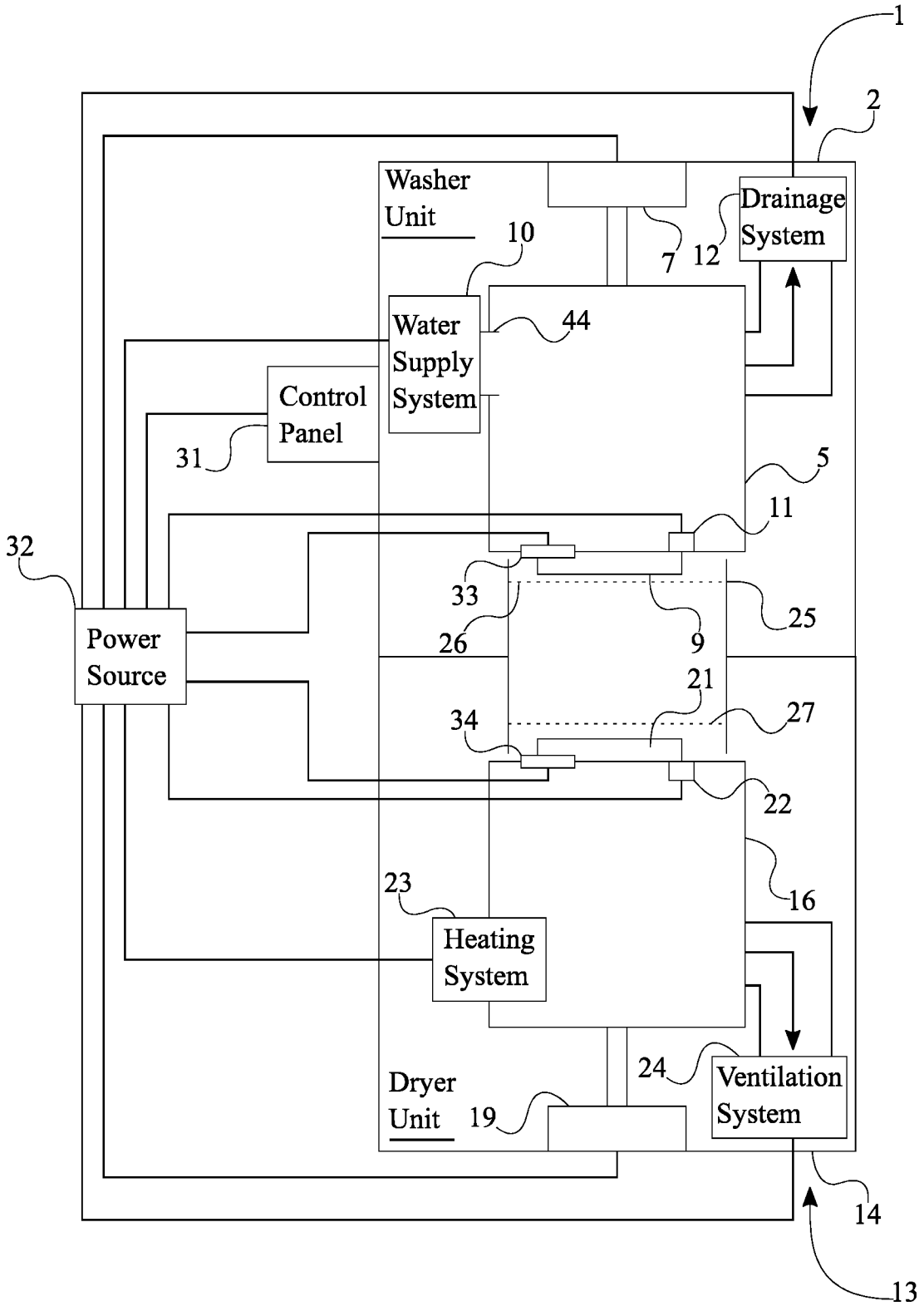
FIG. 15 is a schematic view of the of the electrical components of the dryer unit with the power source of the present invention.

The user is able to control the washer unit 1 as the control unit 30 is electronically connected to the first motor 7, and the power source 32 is electrically connected to the first motor 7, seen in FIG. 6. In order for the wet garments within the washer unit 1 to be directly transferred into the dryer unit 13 and automatically exit the washer unit 1, the first channel opening 8 is concentrically positioned with the output opening 27 of the transfer channel 25, as commanded by the control unit 30, seen in FIG. 5. More specifically, in order for the wet garments to be directly and automatically transferred upon the completion of rinsing and cleaning, the washer unit 1 further comprises an input door actuator 11 and an input door lock 33, as shown in FIG. 14 and FIG. 15. Similar to the release door actuator 29, the input door actuator 11 automatically opens and closes the first channel opening 8 with the input door 9. The input door 9 look ensures the closure and seal of the first channel opening 8 with the input door 9 while the washer unit 1 is rinsing and cleaning the soiled garments. More specifically, the input door actuator 11 is operatively coupled in between the washer drum 5 and the input door 9, wherein the input door actuator 11 is used to open and close the first channel opening 8 with the input door 9. Furthermore, the input door lock 33 is operatively coupled in between the washer drum 5 and the input door 9, wherein the input door lock 33 is used to lock and unlock the input door 9 from the washer drum 5. In order for the input door actuator 11 and the input door lock 33 to operate with respect with the other electrical components of the present invention, the control unit 30 is electronically connected to the input door actuator 11 and the input door lock 33. Similarly, the power source 32 is electrically connected to the input door actuator 11 and the input door lock 33.

The washer unit 1 is able to thoroughly rinse and clean soiled garments as the washer unit 1 further comprises an inlet 44, a water supply system 10, and a drainage system 12, also seen in FIG. 14 and FIG. 15. The inlet 44 allows the water supply system 10 to deliver water into the washer drum 5. The water supply system 10 delivers the water into the washer drum 5 according to the preferences inputted by the user with the control panel 31. Such preferences may include an automatic mixing of detergent and bleach from at least one reservoir which stores the detergent and bleach and is integrated within washer unit 1. The at least one reservoir is preferably operatively coupled with the water supply system 10, wherein the at least one reservoir delivers a dosage of detergent and bleach to the washer drum 5 with the water supply system 10. The drainage system 12 removes excess water from the washer drum 5 upon the completion of the rinsing and cleaning of the soiled garments. The water supply system 10 is in fluid communication with the washer drum 5 with the inlet 44, preventing any water from damaging any other electrical components within the washer unit 1. Similarly, the drainage system 12 is in fluid communication with the washer drum 5, preventing any water that is removed from the washer drum 5 from damaging any other electrical components within the washer unit 1. In order for the user to control the water supply system 10 and the drainage system 12, the control unit 30 is electronically connected to the water supply system 10 and the drainage system 12. In order for the water supply system 10 and the drainage system 12 to operate, the power source 32 is electrically connected to the water supply system 10 and the drainage system 12.

Similar to the washer unit 1, the dryer unit 13 comprises a second outer shell 14, a second door opening 15, a dryer door 16, a dryer drum 17, a second motor 19, a second channel opening 20, and an output door 21, seen in FIG. 3, FIG. 5, FIG. 6, and FIG. 7. The dryer unit 13 dries the wet garments that exit the washer unit 1 and traverse through the transfer channel 25. The second outer shell 14 contains dryer drum 17, the second motor 19, and the output door 21. The second door opening 15 allows dried clothes to be removed from the dryer unit 13. The dryer door 16 seals the second door opening 15 as the dryer unit 13 dries the wet garments. The dryer drum 17 contains the wet garments within the second outer shell 14 while the wet garments are being dried. The second motor 19 rotates the dryer drum 17 which effectively tumbles the wet garments within the dryer drum 17. The second channel opening 20 allows the wet garments within the washer drum 5 to automatically enter the dryer unit 13 and directly enter the dryer drum 17 through the transfer channel 25. The output door 21 seals the dryer drum 17, effectively containing both the wet garments and the heat within the dryer drum 17.

The overall configuration of the aforementioned components allows to dryer unit 13 to effectively dry wet garments and transfer wet clothes directly to the dryer unit 13 without the user having to manually move the clothes into the dryer unit 13. The second door opening 15 laterally traverses through the second outer shell 14, and the dryer door is hingedly connected to the first outer shell 2, positioned adjacent the second door opening 15, as seen in FIG. 1 and FIG. 3 This arrangement allows the user to remove dry garments within the dryer unit 13 and seal the dryer unit 13 while the wet garments are being dried. More specifically, the dryer drum 17 is positioned within the second outer shell 14, and a main opening 18 of the dryer drum 17 is positioned adjacent the second door opening 15. In order for the wet garments to be thoroughly dried, regardless of the number of wet garments within the dryer drum 17, the dryer drum 17 is rotatably mounted within the second outer shell 14 with the second motor 19. In order for the wet garments to automatically enter the dryer unit 13, the second channel opening 20 laterally traverses through the dryer drum 17. The output door 21 is slidably connected to the dryer drum 17 in order for the output door 21 to be able to open the second channel opening 20 and close the second channel opening 20 after the rinsing and cleaning of the soiled garments and during the drying of the wet garments, respectively. More specifically, the output door 21 is positioned adjacent the second channel opening 20.

The user is able to control the dryer unit 13 as the control unit 30 is electronically connected to the second motor 19, and the power source 32 is electrically connected to the second motor 19, seen in FIG. 6. In order for the wet garments within the washer unit 1 to be directly transferred into the dryer unit 13 and automatically enter the dryer unit 13, the second channel opening 20 is concentrically positioned with the output opening 27 of the transfer channel 25, as commanded by the control unit 30, seen in FIG. 5. Similar to the washer unit 1, in order for the wet garments to be directly and automatically transferred, the dryer unit 13 further comprises an output door actuator 22 and an output door lock 34, as shown in FIG. 14 and FIG. 15. Similar to the release door actuator 29 and the input door actuator 11, the output door actuator 22 automatically opens and closes the second channel opening 20 with the output door 21. The output door lock 34 ensures the closure and seal of the second channel opening 20 with the output door 21 while the dryer unit 13 is drying the wet garments. More specifically, the output door actuator 22 is operatively coupled in between the dryer drum 17 and the output door 21, wherein the output door actuator 22 is used to open and close the second channel opening 20 with the output door 21. Furthermore, the output door lock 34 is operatively coupled in between the dryer drum 17 and the output door 21, wherein the output door lock 34 is used to lock and unlock the output door 21 from the dryer drum 17. In order for the output door actuator 22 and the output door lock 34 to operate with respect with the other electrical components of the present invention, the control unit 30 is electronically connected to the output door actuator 22 and the output door lock 34. Similarly, the power source 32 is electrically connected to the output door actuator 22 and the output door lock 34.

The dryer unit 13 is able to effectively dry wet garments as the dryer unit 13 further comprises a heating system 23 and a ventilation system 24, also seen in FIG. 14 and FIG. 15. The heating system 23 delivers heat within the dryer drum 17, effectively drying the wet garments within the dryer drum 17. The ventilation system 24 maintains the desired temperature within the dryer unit 13 while maintaining the safety of the dryer unit 13. In order for the wet garments to receive the heat from the heating system 23, the heating system 23 is integrated into the dryer drum 17. The ventilation system 24 maintains the temperature while preserving the integrity of the wet garments and the dryer unit 13 as the ventilation system 24 is in fluid communication with the dryer drum 17. In alternate embodiments of the present invention, the ventilation system 24 may further comprise a lint filtering system, a lint sensor, and a lint alert device. The lint-filtering system is operatively coupled within the dryer drum 17 wherein the lint filtering system is used to collect lint that separates from the wet garments as the heating system 23 dries the wet garments. The lint sensor detects the excessive buildup of lint within a lint-receiving screen. The lint alert device notifies the user of the excessive buildup. The lint sensor and the lint alert device are electronically connected to the control unit 30 in order for the user to be effectively notified and stop the heating system 23 upon the detection of lint buildup. The lint sensor and the lint alert device are electrically connected to the power source 32 in order to operate. The lint alert device preferably alerts the user to clean or change the lint-receiving screen regularly, regardless if excessive buildup is not detected. More specifically, the lint alert device notifies the user to clean or change the lint-receiving screen every 30 days. In order for the user to control the heating system 23 and the ventilation system 24, the control unit 30 is electronically connected to the heating system 23 and the ventilation system 24. In order for the heating system 23 and the ventilation system 24 to operate, the power source 32 is electrically connected to the heating system 23 and the ventilation system 24.

Figure 7:
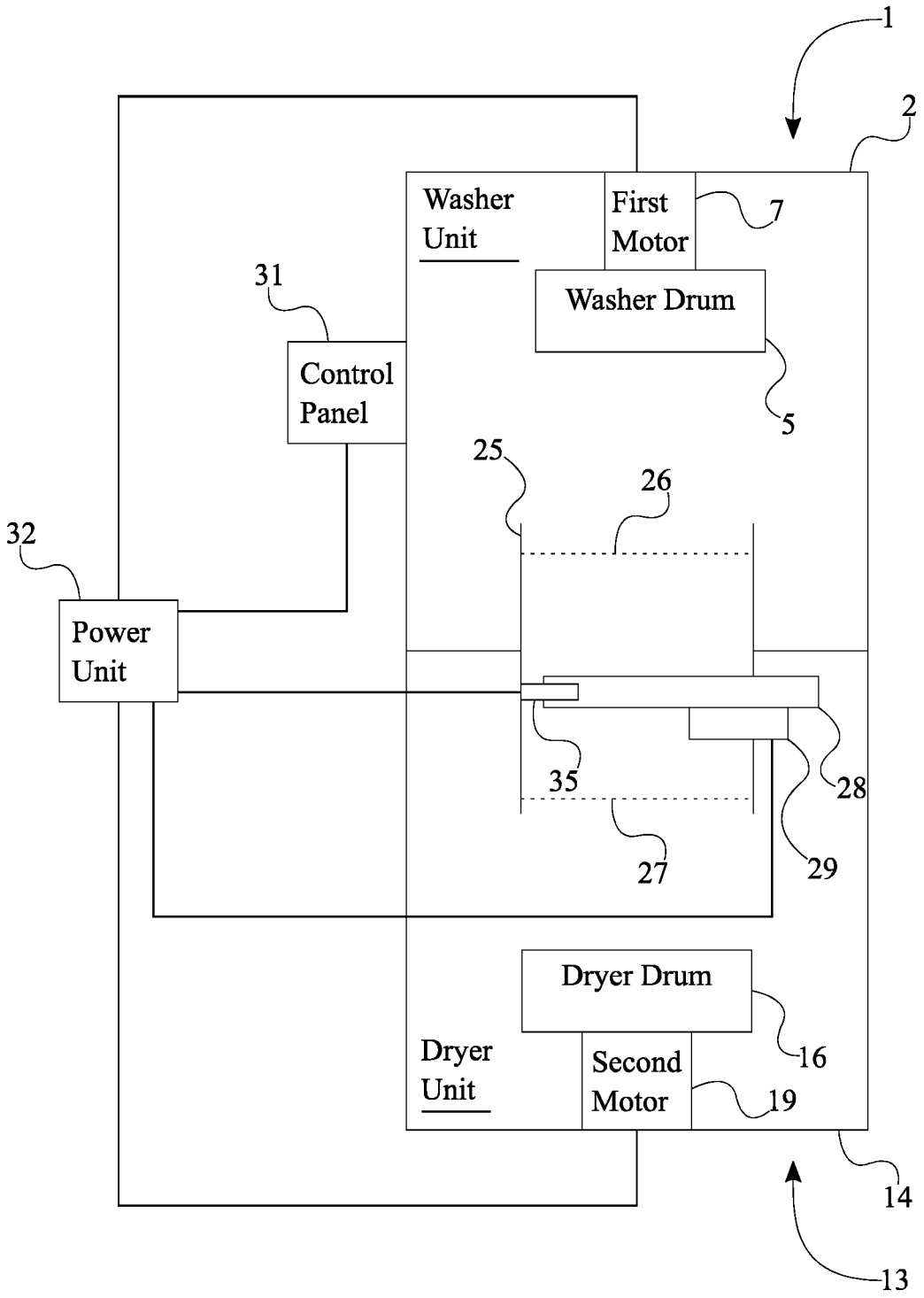
FIG. 7 is a schematic view of the of the electrical components of the present invention with the power source.

The wet garments that exit the washer unit 1 do not come into contact with the dryer drum 17 while the dryer unit 13 is in the process of drying previously washed garments with the heating system 23 and the ventilation system 24 as the present invention further comprises a release door lock 35, as shown in FIG. 6 and FIG. 7. Similar to that of the input door lock 33 and the output door lock 34, the release door lock 35 is operatively coupled in between the transfer channel 25 and the release door 28, wherein the release door 28 is used to lock and unlock the release door 28 from the transfer channel 25 tube. In order for the release door lock 35 to operate with respect with the other electrical components of the present invention, the control unit 30 is electronically connected to the release door lock 35. Similarly, the power source 32 is electrically connected to the release door lock 35.

Figure 8:
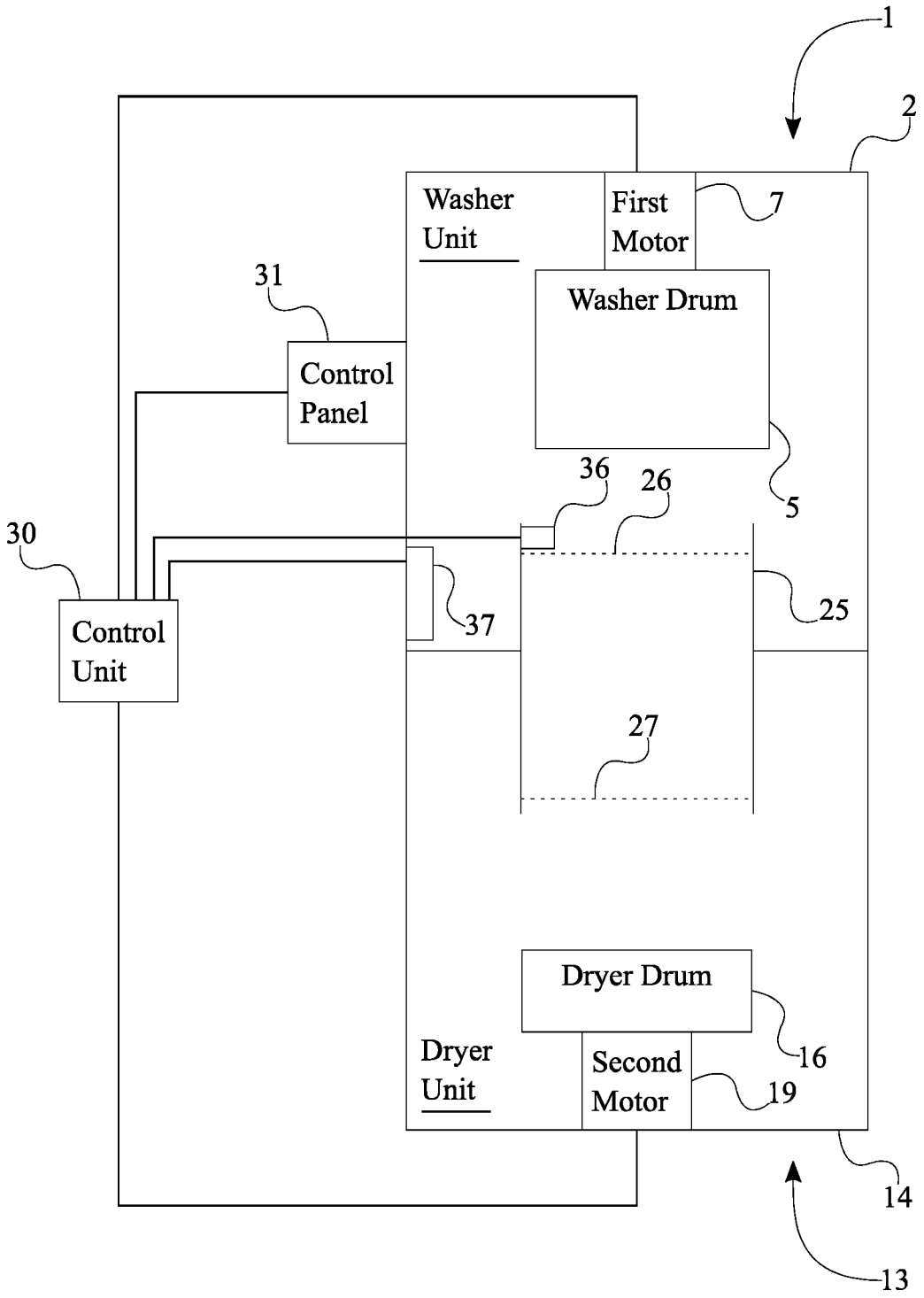
FIG. 8 is a schematic view of the of the electrical components of the present invention, specifically the primary proximity sensor and the primary alert device, with the control unit, wherein the primary alert device is connected with the washer unit.
Figure 9:
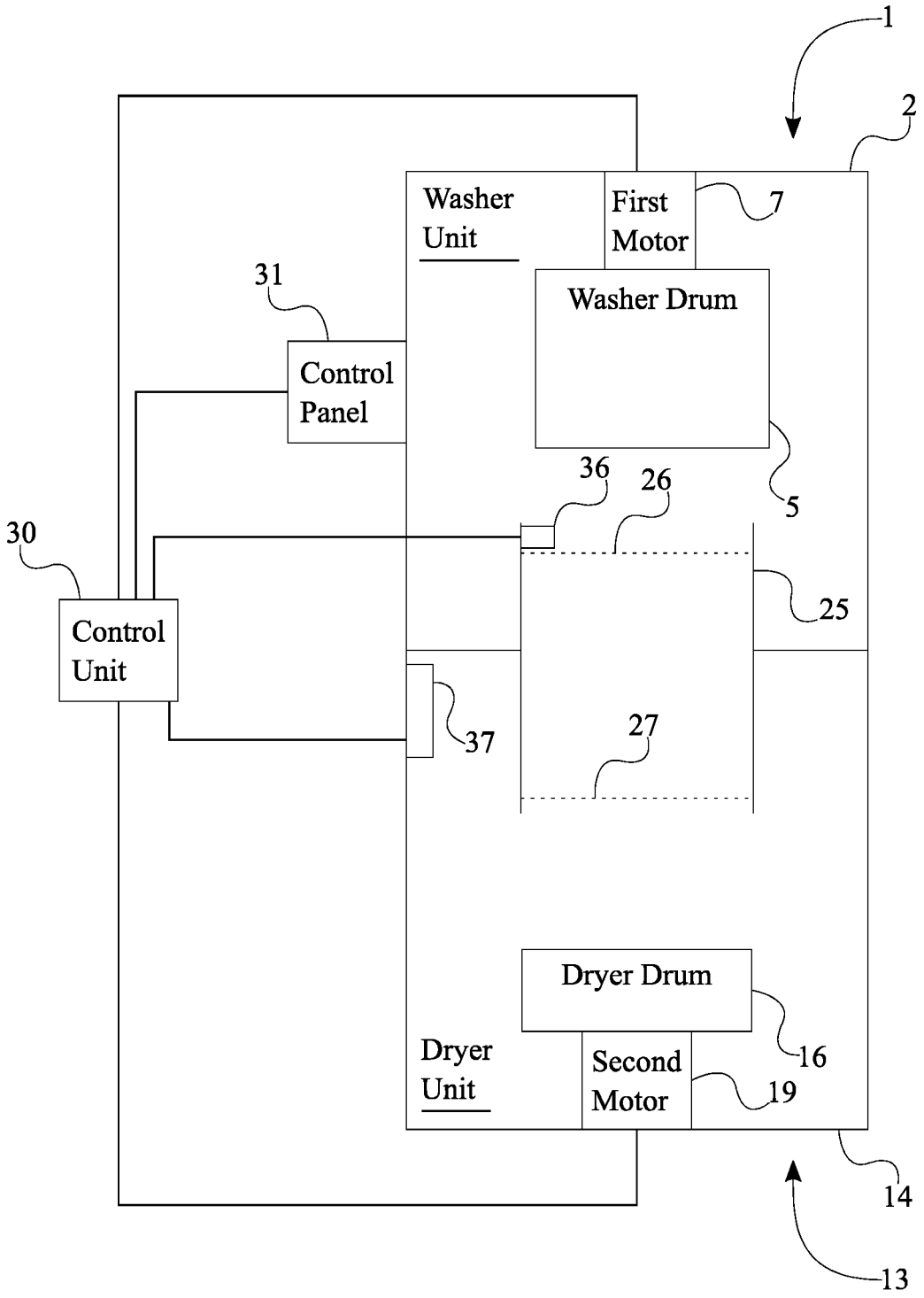
FIG. 9 is a schematic view of the of the electrical components of the present invention, specifically the primary proximity sensor and the primary alert device, with the control unit, wherein the primary alert device is connected with the dryer unit.
Figure 10:
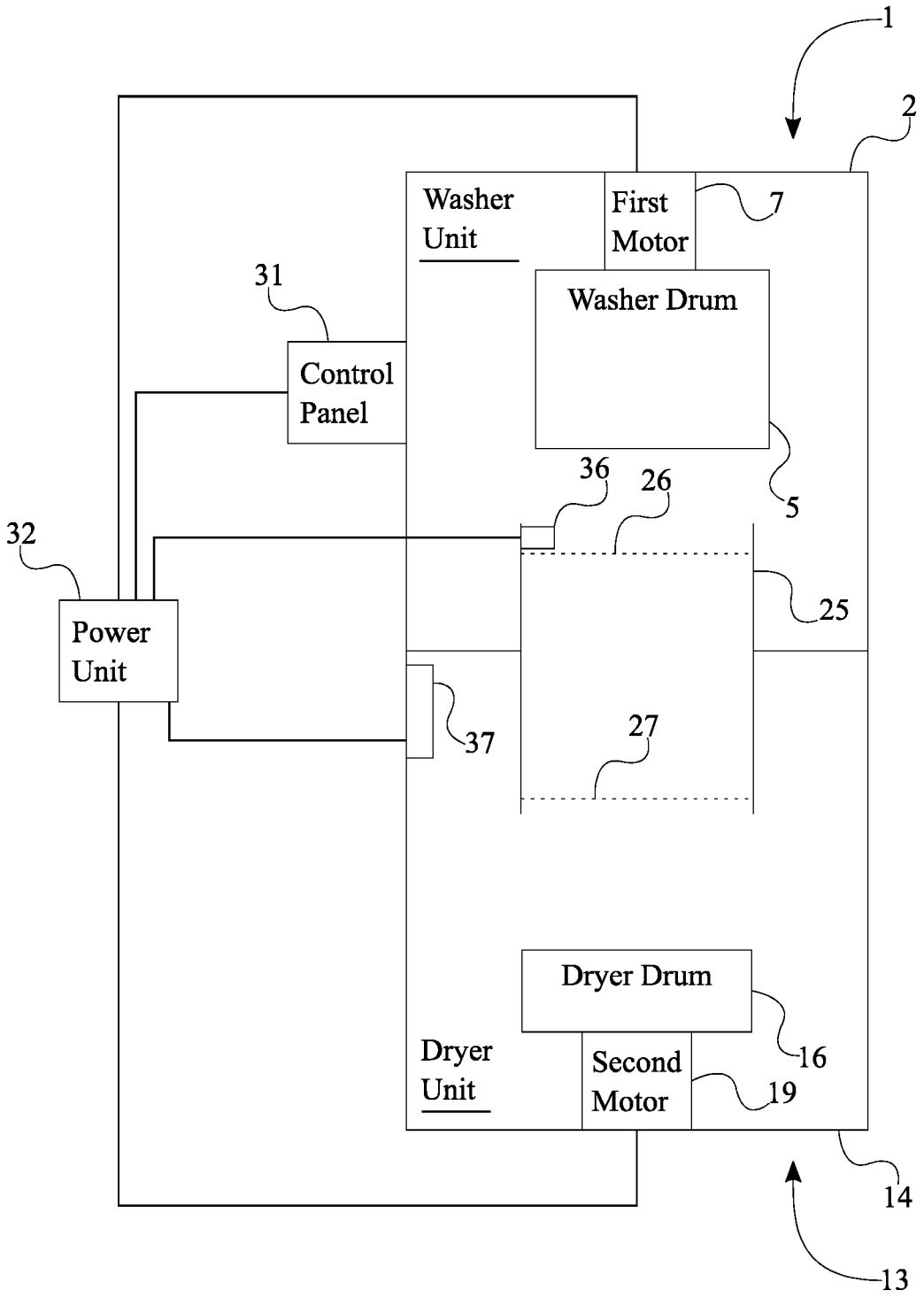
FIG. 10 is a schematic view of the of the electrical components of the present invention, specifically the primary proximity sensor and the primary alert device, with the power source.

The present invention alerts the user if any wet garment is hanging into and out of the transfer channel 25 as the present invention further comprises a primary proximity sensor 36 and a primary alert device 37, shown in FIG. 8, FIG. 9, and FIG. 10. The primary proximity sensor 36 detects the presence of a garment within the transfer channel 25, and the primary alert device 37 visually and audibly notifies the user of the detection of the presence of a garment by the primary proximity sensor 36. More specifically, the primary proximity sensor 36 operatively traverses into the transfer channel 25 in between the input opening 26 and the output opening 27, wherein the primary proximity sensor 36 is used to detect a garment item in between the input opening 26 and the output opening 27. Upon the detection of a garment hanging into or hanging from the transfer channel 25, the washer unit 1 and the drier unit do not operate as the primary proximity sensor 36 is electronically connected to the control unit 30. This connection prevents the damaging of the garment, the washer unit 1, the release door 28, and the dryer unit 13. The user is notified upon the detection of the garment as the primary alert device 37 is electronically connected to the control unit 30 as well. The primary proximity sensor 36 and the primary alert device 37 are able to operate as the primary proximity sensor 36 and the primary alert device 37 are electrically connected to the power source 32. In a first embodiment of the present invention, the primary alert device 37 is connected within the washer unit 1, shown in FIG. 8. In a second embodiment of the present invention, the primary alert device 37 is connected within the dryer unit 13, shown in FIG. 9. The position of the primary alert device 37, whether within the washer unit 1 or the dryer unit 13, maximizes the visual and audible notification of the primary alert device 37 to the user.

Figure 11:
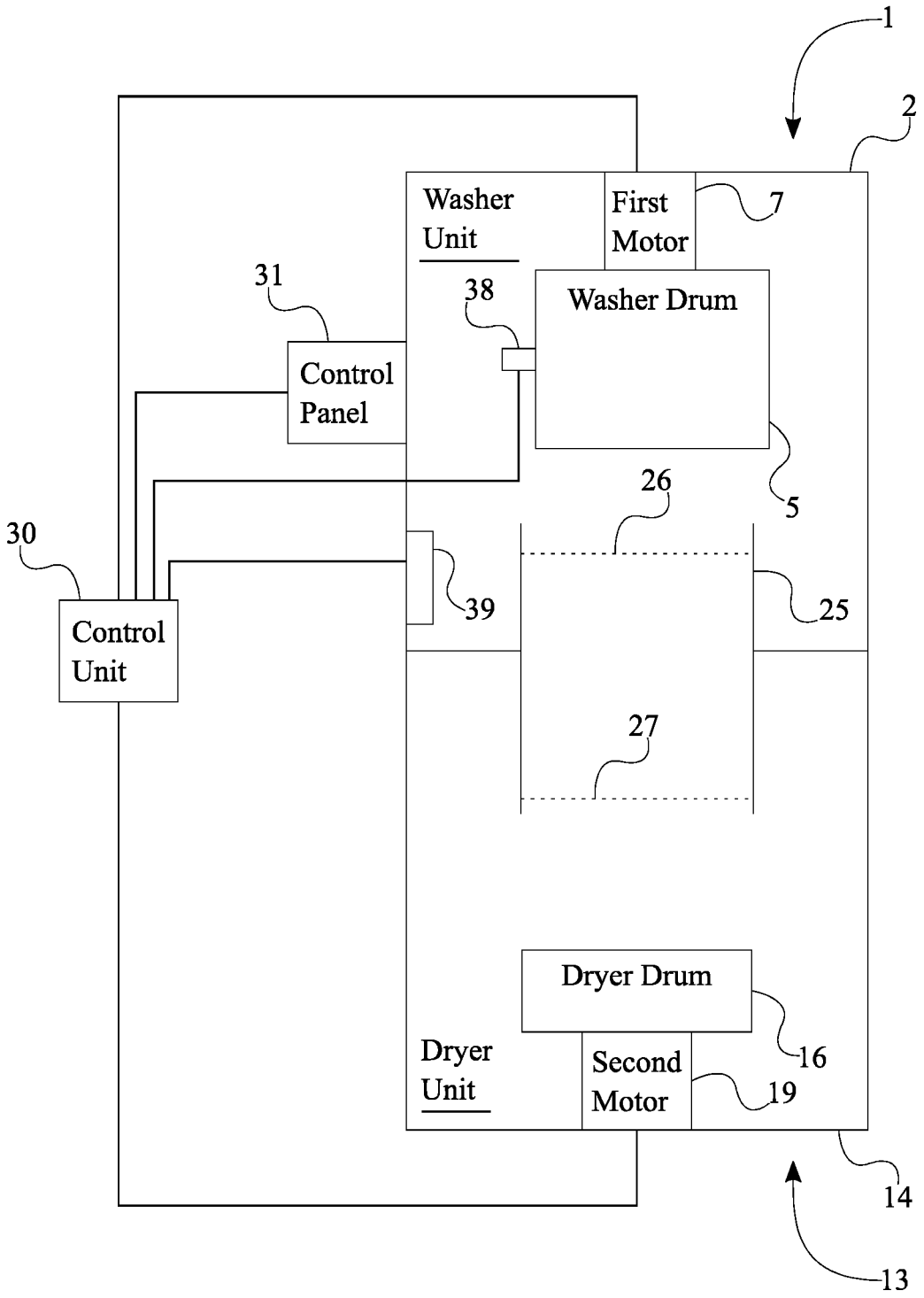
FIG. 11 is a schematic view of the of the electrical components of the present invention, specifically the secondary proximity sensor and the secondary alert device, with the control unit.
Figure 12:
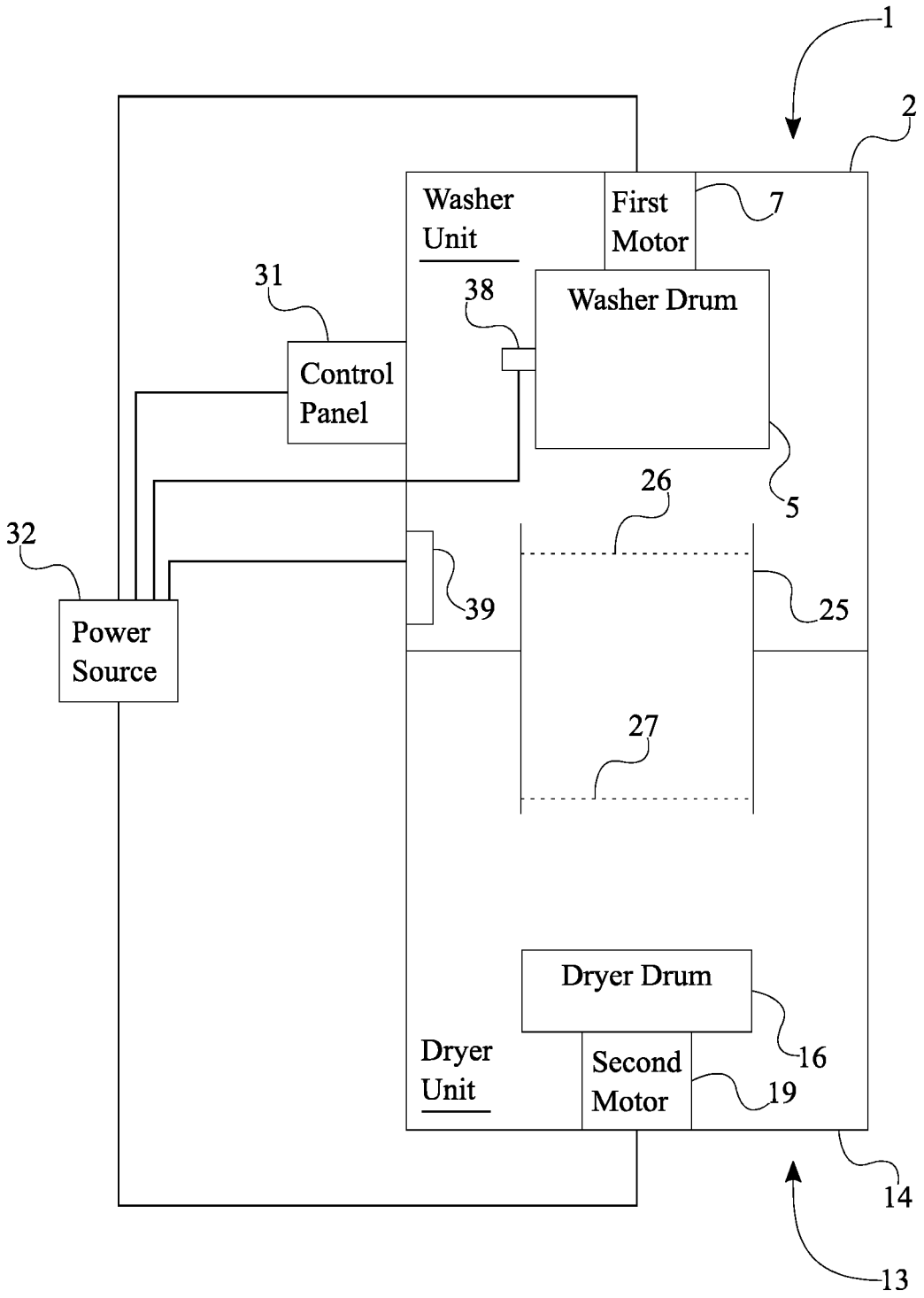
FIG. 12 is a schematic view of the of the electrical components of the present invention, specifically the secondary proximity sensor and the secondary alert device, with the power source.

The present invention further comprises a secondary proximity sensor 38 and a secondary alert device 39, shown in FIG. 11 and FIG. 12. The secondary proximity sensor 38 detects a wet garment that did not automatically exit the washer unit 1 through the transfer channel 25. Similar to the primary alert device 37, the secondary alert device 39 visually and audibly alerts the user of the presence of a wet garment within the washer unit 1. Moreover, the secondary proximity sensor 38 is operatively positioned within the washer unit 1, wherein the secondary proximity sensor 38 is used to detect a garment within the washer unit 1. Upon the detection of a wet garment within the washer unit 1, the washer unit 1 and the drier unit do not operate as the secondary proximity sensor 38 is electronically connected to the control unit 30, thereby ensuring the drying of all the wet garments within the washer unit 1. The user is notified upon the detection of the garment as the secondary alert device 39 is electronically connected to the control unit 30. The secondary proximity sensor 38 and the secondary alert device 39 are able to operate as the secondary proximity sensor 38 and the secondary alert device are electrically connected to the power source 32.

Figure 13:
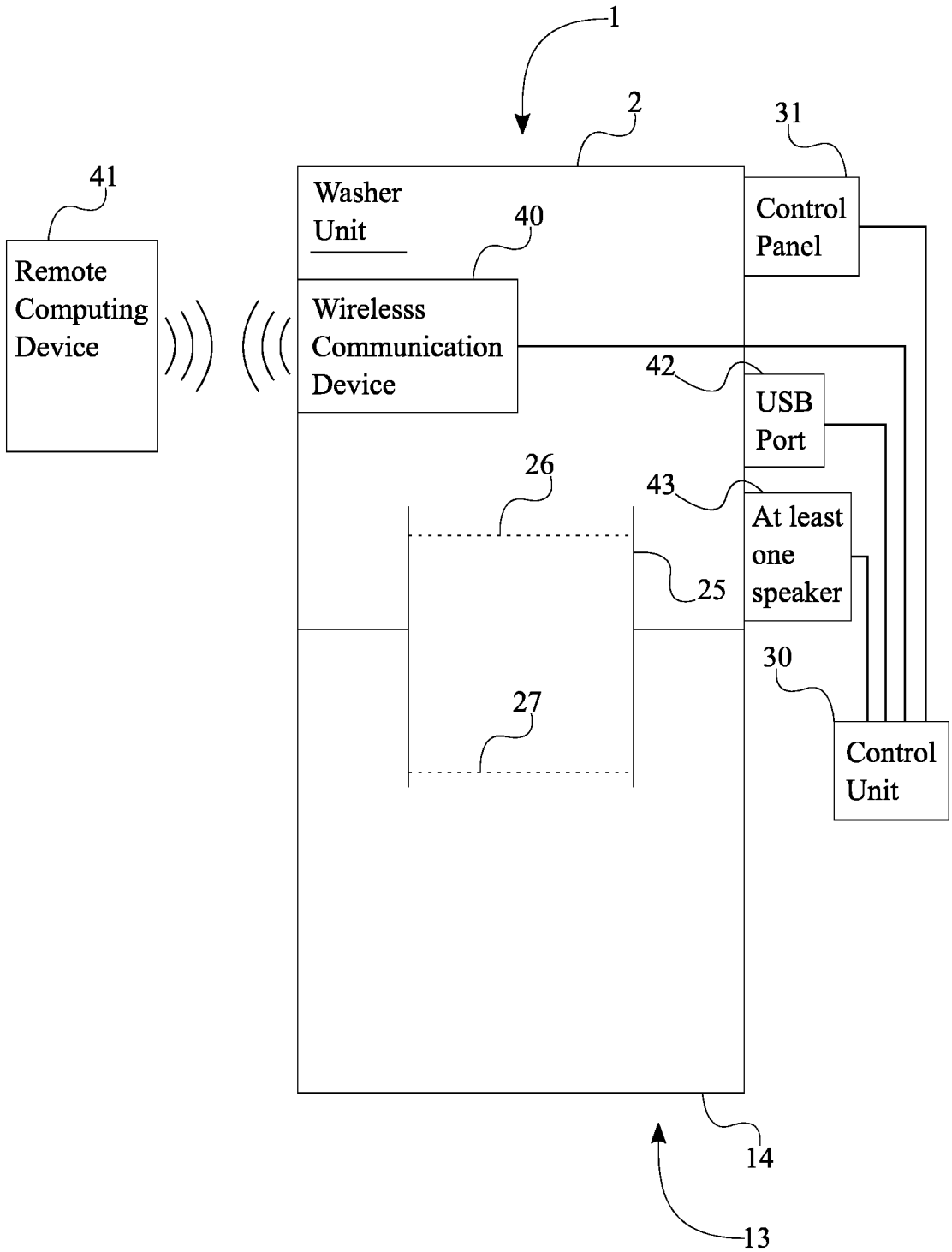
FIG. 13 is a schematic view of the of the wireless communication between the remote computing device and the wireless communication device and the electronic connection between the wireless communication device, the USB port, and the at least one speaker with the control unit of the present invention.

In order for the present invention to be remotely controlled, the present invention further comprises a wireless communication device 40 and a remote computing device 41, as shown in FIG. 13. The wireless communication device 40 wirelessly connects the remote computing device 41 to the control unit 30. The remote computing device 41 allows the user to input specific commands and preferences. The remote computing device 41 is preferably a smart phone. However, it is understood that the remote computing device 41 may include, but is not limited to, a smart watch, a tablet, and so on. Such preferences may include wash times, transfer times, dry times, wash setting preferences, and drying preferences. The present invention further comprises a USB port 42 and at least one speaker 43, also shown in FIG. 13. The USB port 42 allows the remote computing device 41 to directly connect to the control unit 30. In addition to the remote computing device 41, a variety of compatible computing devices may be connected to the USB port 42 in order to connect with the control unit 30 and the at least one speaker 43. The at least one speaker 43 allows the remote computing device 41 to emit audio through the at least one speaker 43 with a louder volume. The control unit 30 is electronically connected to the wireless communication device 40, the USB port 42, and the at least one speaker 43, thereby allowing the remote computing system to wireless connect with the electrical components of the present invention. Moreover, the remote computing device 41 is communicably coupled to the wireless communication device 40. The power source 32 is electrically connected to the wireless communication device 40 and the at least one speaker 43, allowing both the wireless communication device 40 and the at least one speaker 43 to operate. In the preferred embodiment of the present invention, the at least one speaker 43 is externally mounted to the washing unit. It is understood that in various embodiments of the present invention, the at least one speaker 43 is externally mounted onto various positions about the washer unit 1 and the dryer unit 13.

Although the invention has been explained in relation to its preferred embodiment, it is to be understood that many other possible modifications and variations can be made without departing from the spirit and scope of the invention as hereinafter claimed.

What is claimed is:

1. An automatic garment washer and dryer machine comprises:

a washer unit;
a dryer unit;
a transfer channel;
a release door;
a release door actuator;
a control unit;
a control panel;
a power source;
the washer unit being positioned adjacent the dryer unit;
an input opening of the transfer channel traversing from the washer unit;
an output opening of the transfer channel traversing into the dryer unit;

the release door being positioned adjacent to the output opening of the transfer channel;

the release door actuator being operatively coupled in between the transfer channel and the release door, wherein the release door actuator is used to open and close the output opening of the transfer channel with the release door;

the control unit being electronically connected to the washer unit, the dryer unit, the release door actuator, and the control panel;

the power source being electrically connected to the control unit, the washer unit, the dryer unit, the release door actuator, and the control panel;

a primary proximity sensor;

the primary proximity sensor operatively traversing into the transfer channel in between the input opening and the output opening, wherein the primary proximity sensor is used to detect a garment item between the input opening and the output opening;

the primary proximity sensor being electronically connected to the control unit; and the primary proximity sensor being electrically connected to the power source.

2. The automatic garment washer and dryer machine as claimed in claim 1 comprises:

the washer unit comprises a first outer shell, a first door opening, a washer door, a washer drum, a first motor, a first channel opening, and an input door;

the first door opening laterally traversing through the first outer shell;

the washer door being hingedly connected to the first outer shell, positioned adjacent the first door opening;

the washer drum being positioned within the first outer shell;

a main opening of the washer drum being positioned adjacent the first door opening;

the washer drum being rotatably mounted within the first outer shell with the first motor;

the first channel opening laterally traversing through the washer drum;

the input door being slidably connected to the washer drum; and the input door being positioned adjacent the first channel opening.

3. The automatic garment washer and dryer machine as claimed in claim 2 comprises:

the control unit being electronically connected to the first motor; and the power source being electrically connected to the first motor.

4. The automatic garment washer and dryer machine as claimed in claim 2 comprises:

the first channel opening being concentrically positioned with the output opening of the transfer channel.

5. The automatic garment washer and dryer machine as claimed in claim 2 comprises:

the washer unit further comprises an input door actuator and an input door lock;

the input door actuator being operatively coupled in between the washer drum and the input door, wherein the input door actuator is used to open and close the first channel opening with the input door;

the input door lock being operatively coupled in between the washer drum and the input door, wherein the input door lock is used to lock and unlock the input door from the washer drum;

the control unit being electronically connected to the input door actuator and the input door lock; and the power source being electrically connected to the input door actuator and the input door lock.

6. The automatic garment washer and dryer machine as claimed in claim 2 comprises:

the washer unit further comprises an inlet, a water supply system, and a drainage system;

the water supply system being in fluid communication with the washer drum with the inlet;

the drainage system being in fluid communication with the washer drum;

the control unit being electronically connected to the water supply system and the drainage system; and the power source being electrically connected to the water supply system and the drainage system.

7. The automatic garment washer and dryer machine as claimed in claim 1 comprises:

the dryer unit comprises a second outer shell, a second door opening, a dryer door, a dryer drum, a second motor, a second channel opening, and an output door;

the second door opening laterally traversing through the second outer shell;

the dryer door being hingedly connected to the second outer shell, positioned adjacent the second door opening;

the dryer drum being positioned within the second outer shell;

a main opening of the dryer drum being positioned adjacent the second door opening;

the dryer drum being rotatably mounted within the second outer shell with the second motor;

the second channel opening laterally traversing through dryer drum;

the output door being slidably connected to the dryer drum; and the output door being positioned adjacent the second channel opening.

8. The automatic garment washer and dryer machine as claimed in claim 7 comprises:

the control unit being electronically connected to the second motor; and the power source being electrically connected to the second motor.

9. The automatic garment washer and dryer machine as claimed in claim 7 comprises:

the second channel opening being concentrically positioned with the output opening of the transfer channel.

10. The automatic garment washer and dryer machine as claimed in claim 7 comprises:

the dryer unit further comprises an output door actuator and an output door lock;

the output door actuator being operatively coupled in between the dryer drum and the output door, wherein the output door actuator is used to open and close the second channel opening with the output door;

the output door lock being operatively coupled in between the dryer drum and the output door, wherein the output door lock is used to lock and unlock the output door from the dryer drum;

the control unit being electronically connected to the output door actuator and the output door lock; and the power source being electrically connected to the output door actuator and the output door lock.

11. The automatic garment washer and dryer machine as claimed in claim 7 comprises:

the dryer unit further comprises a heating system and a ventilation system;

the heating system being integrated into the dryer drum; and the ventilation system being in fluid communication with the dryer drum;

the control unit being electronically connected to the heating system and the ventilation system; and the power source being electrically connected to the heating system and the ventilation system.

12. The automatic garment washer and dryer machine as claimed in claim 1 comprises:

a release door lock;

the release door lock being operatively coupled in between the transfer channel and the release door, wherein the release door lock is used to lock and unlock the release door from the transfer channel;

the control unit being electronically connected to the release door lock; and the power source being electrically connected to the release door lock.

13. The automatic garment washer and dryer machine as claimed in claim 1 comprises:

a primary alert device;

the primary alert device being electronically connected to the control unit; and the primary alert device being electrically connected to the power source.

14. The automatic garment washer and dryer machine as claimed in claim 13 comprises:

the primary alert device being connected within the washer unit.

15. The automatic garment washer and dryer machine as claimed in claim 13 comprises:

the primary alert device being connected within the dryer unit.

16. The automatic garment washer and dryer machine as claimed in claim 1 comprises:

a secondary proximity sensor;

a secondary alert device;

the secondary proximity sensor being operatively positioned within the washer unit, wherein the secondary proximity sensor is used to detect a garment within the washer unit;

the secondary proximity sensor being electronically connected to the control unit;

the secondary alert device being electronically connected to the control unit; and the secondary proximity sensor and the secondary alert device being electrically connected to the power source.

17. The automatic garment washer and dryer machine as claimed in claim 1 comprises:

a wireless communication device;

a remote computing device;

a USB port;

at least one speaker;

the control unit being electronically connected to the wireless communication device, the USB port, and the at least one speaker;

the remote computing device being communicably coupled to the wireless communication device; and the power source being electrically connected to the wireless communication device and at least one speaker.

18. The automatic garment washer and dryer machine as claimed in claim 17 comprises:

the at least one speaker being externally mounted to the washer unit.

* * * * *